US011937745B2

(12) United States Patent
Yang

(10) Patent No.: US 11,937,745 B2
(45) Date of Patent: Mar. 26, 2024

(54) FOLDING BATHTUB

(71) Applicant: Yuzhao Jin, Zhejiang (CN)

(72) Inventor: Tao Yang, Taizhou (CN)

( * ) Notice: Subject to any disclaimer, the term of this patent is extended or adjusted under 35 U.S.C. 154(b) by 0 days.

(21) Appl. No.: 17/962,579

(22) Filed: Oct. 10, 2022

(65) Prior Publication Data

US 2023/0270294 A1 Aug. 31, 2023

(30) Foreign Application Priority Data

Feb. 25, 2022 (CN) ..... 202220405894.2

(51) Int. Cl.
*A47K 3/06* (2006.01)

(52) U.S. Cl.
CPC ..... *A47K 3/06* (2013.01)

(58) Field of Classification Search
CPC ..... A47K 3/06
See application file for complete search history.

(56) References Cited

U.S. PATENT DOCUMENTS

2022/0079390 A1* 3/2022 Pruzhansky ..... A47K 3/024
2023/0248185 A1* 8/2023 Gabriel ..... A47K 3/06 4/599

FOREIGN PATENT DOCUMENTS

CN 207949708 U * 10/2018
CN 215127782 U * 12/2021

* cited by examiner

*Primary Examiner* — Christine J Skubinna

(57) ABSTRACT

A folding bathtub includes a tub body; and a supporting ring. The supporting ring is arranged on the tub body. The supporting ring comprises a left ring part, a right ring part and an upper folding part, the left ring part and the right ring part are respectively arranged on two sides of an upper end of the tub body, and the upper folding part is arranged between the left ring part and the right ring part. The upper folding part is made of a soft material. The supporting ring achieves rotatable folding between the left ring part and the right ring part by means of deformation of the upper folding part, and the supporting ring is folded to drive the tub body to deform and be folded.

14 Claims, 6 Drawing Sheets

FOLDING BATHTUB

CROSS-REFERENCE TO RELATED APPLICATIONS

The application claims priority of Chinese patent application 202220405894.2, filed on Feb. 25, 2022, which is incorporated herein by reference in its entireties.

TECHNICAL FIELD

The present disclosure relates to the technical field of bathtubs, in particular, to a folding bathtub.

BACKGROUND

The structure of a folding bathtub in the prior art is usually composed of a tub body and a supporting ring above the tub body. However, the supporting ring is usually divided into two parts hinged together, and the two parts of the supporting ring are rotated to be folded to drive the tub body to deform and be folded, thus achieving the folding of the entire folding bathtub.

However, this folding structure is relatively complicated, and a producer needs to perform perforation, positioning, bolting and the like to achieve connection; the mounting is relatively complicated; and the production efficiency is relatively low.

SUMMARY

The present disclosure provides a folding bathtub.

A folding bathtub, including: a tub body; and a supporting ring, which is arranged on the tub body, the supporting ring includes a left ring part, a right ring part and an upper folding part; the left ring part and the right ring part are respectively arranged on two sides of an upper end of the tub body; the upper folding part is arranged between the left ring part and the right ring part; the upper folding part is made of a soft material; the supporting ring achieves rotatable folding between the left ring part and the right ring part by means of deformation of the upper folding part; and the supporting ring is folded to drive the tub body to deform and be folded.

Further, a lower surface of the upper folding part is provided with a stopper, and two ends of the stopper respectively extend to the left ring part and the right ring part to limit downward rotation of the left ring part and the right ring part.

Further, the tub body includes: a left tub body and a right tub body, which are respectively connected to the left ring part and the right ring part; and a lower folding part, which is arranged between the left tub body and the right tub body, and is connected to the upper folding part; and the lower folding part is made of a soft material; and the upper folding part deforms to drive the lower folding part to deform, which achieves folding between the left tub body and the right tub body.

Further, upper ends of the left tub body and the right tub body are respectively provided with a left extensible part and a right extensible part; the left extensible part and the right extensible part are respectively connected to the left ring part and the right ring part; the left extensible part and the right extensible part are both made of a soft material; and extensible folding up and down between the supporting ring and the tub body is achieved through the deformations of the left extensible part and the right extensible part as well as the lower folding part.

Further, lower ends of the left tub body and the right tub body are respectively provided with a left supporting part and a right supporting part; and the left supporting part and the right supporting part are both made of a hard material to limit the deformation of the tub body.

Further, the left extensible part, the right extensible part, the upper folding part and the lower folding part are integrated to form a soft folding part.

Further, the upper folding part, the left ring part and the right ring part are integrally formed, and the left ring part and the right ring part are both made of a hard material.

Further, an outer edge of the supporting ring is downwards folded to form a ring slot, and the stopper is a stop block which is clamped in the ring slot.

Further, the supporting ring and the tub body are integrally formed.

Further, the soft material is a thermoplastic elastomer (TPE) or silica gel, and the hard material is polypropylene (PP) or acrylonitrile butadiene styrene (ABS).

A folding bathtub including: a tub body; and a supporting ring, which includes a first ring part, a second ring part and a first folding part, the first ring part and the second ring part are respectively arranged on two sides of an upper end of the tub body; the first folding part is arranged between the left ring part and the right ring part; the first folding part is made of a soft material; the supporting ring achieves rotatable folding of the first ring part relative to the second ring part by means of deformation of the first folding part, and then the supporting ring is folded to drive the tub body to deform and be folded.

Further, the first folding part is provided with a stopper, and two ends of the stopper respectively extend to the first ring part and the second ring part to limit downward rotation of the first ring part and the second ring part.

Further, the tub body includes: a first tub body and a second tub body, which are respectively connected to the first ring part and the second ring part; and a second folding part, which is arranged between the left tub body and the right tub body, and is connected to the first folding part; and the second folding part is made of a soft material; and the first folding part deforms to drive the second folding part to deform, which achieves folding between the first tub body and the second tub body.

Further, one end of the first tub body and one end of the second tub body are respectively provided with a first extensible part and a second extensible part; the first extensible part and the second extensible part are respectively connected to the first ring part and the second ring part; the first extensible part and the second extensible part are both made of a soft material; and extensible folding up and down between the supporting ring and the tub body is achieved through the deformations of the first extensible part and the second extensible part as well as the second folding part.

Further, lower ends of the first tub body and the second tub body are respectively provided with a first supporting part and the second supporting part; the first supporting part and the second supporting part are both made of a hard material to limit the deformation of the tub body, and the first extensible part, the second extensible part, the first folding part and the second folding part are integrated to form a soft folding part.

The present disclosure has the beneficial effects: the upper folding part made of the soft material connects the left ring part to the right ring part, so that the structure is simple. Meanwhile, the upper folding part, the left ring part and the right ring part can also be connected by means of integrated forming, gluing, welding and the like. In this embodiment, the upper folding part, the left ring part and the right ring part are preferably integrally formed, so that a producer does not perform an additional mounting operation. The mounting step is simple, and the production efficiency is relatively high.

Further, folding up and down is achieved first through the left extensible part and the right extensible part, and transverse folding is then achieved through the upper folding part and the lower folding part. Therefore, the folding bathtub is folded for multiple times, and a storage space of the folding bathtub is smaller.

Further, the left supporting part and the right supporting part are both made of a hard material to limit the deformation of the bottom of the tub body, so that the tub body is maintained in a certain shape to facilitate the use by the user.

Further, the supporting ring and the tub body are integrally formed, and the entire folding bathtub is connected into a whole, thus improving the intensity of the entire folding bathtub, reducing gaps between the structures of the folding bathtub, and improving the airtightness of the folding bathtub to reduce the possibility of water leakage during use of the folding bathtub.

Further, two ends of the stopper respectively extend to the left ring part and the right ring part to limit downward rotation of the left ring part and the right ring part, thus preventing the supporting ring from downwards deforming to affect the shape of the tub body and the use of the entire folding bathtub.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure

DETAILED DESCRIPTION OF THE EMBODIMENT S

Figure 1:
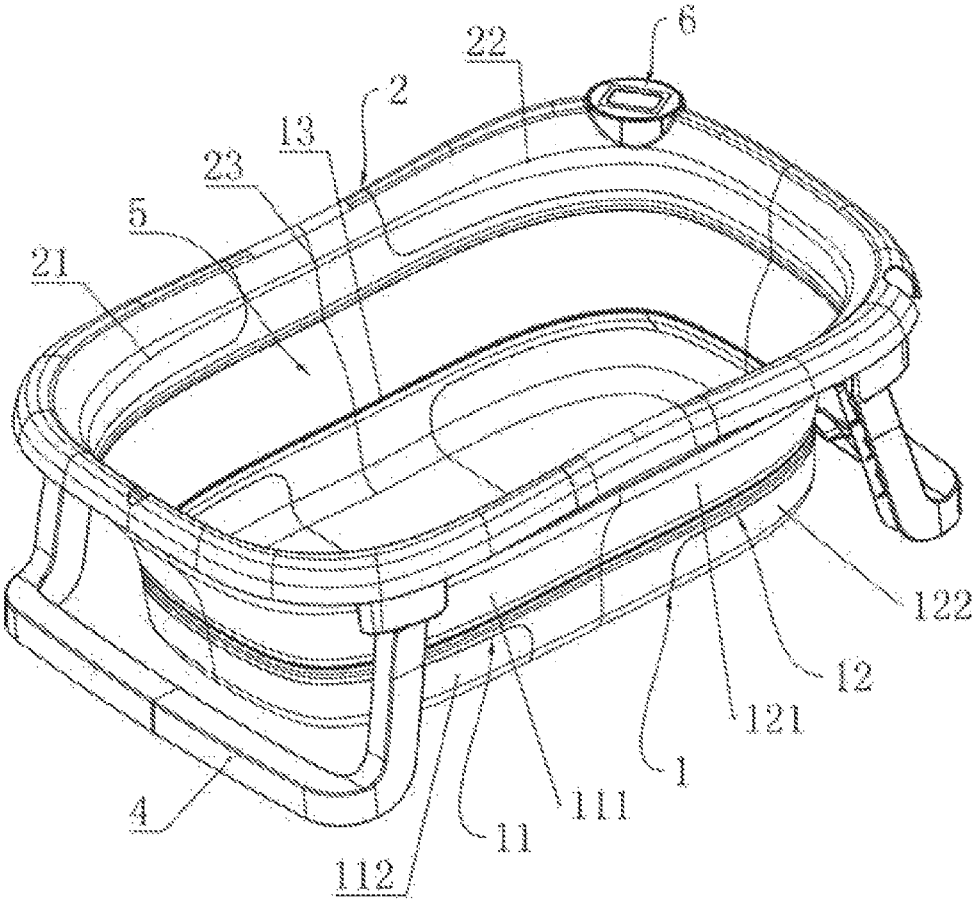
FIG. 1 is a schematic structural diagram of a usage state of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Embodiment 1

As shown in FIG. 1, a folding bathtub includes a tub body 1 and a supporting ring 2. The tub body 1 is used for accommodating liquid; the supporting ring 2 is arranged on the tub body 1 and is used for supporting an opening in an upper end of the tub body 1, so that the opening of the tub body 1 can be kept opened during use of the folding bathtub, and it is convenient to pour the liquid into and out of the tub body 1 and for a user to use the liquid. Meanwhile, left and right sides of the supporting ring 2 are further rotatably provided with supporting feet 4, and the supporting ring 2 is matched with the supporting feet 4 to support the tub body 1.

As shown in FIG. 1-FIG. 5, the supporting ring 2 includes an upper folding part 23, a left ring part 21 and a right ring part 22. The left ring part 21 and the right ring part 22 are respectively arranged on two sides of the upper end of the tub body 1, and the upper folding part 23 is arranged between the left ring part 21 and the right ring part 22. The upper folding part 23 is made of a soft material. A user only needs to hold the left ring part 21 or the right ring part 22 and applies a force to make the upper folding part rotate, thus achieving rotatable folding between the left ring part 21 and the right ring part 22 by means of deformation of the upper folding part 23, and folding the supporting ring 2. Meanwhile, the tub body 1 is at least partially made of a soft material. In this embodiment, preferably, a lower folding part 4 located in the middle of the tub body 1 is made of the soft material. Folding the supporting ring 2 will also drive the tub body 1 to deform and be folded, which finally folds the entire folding bathtub.

The upper folding part 23 made of the soft material connects the left ring part 21 to the right ring part 22, so that the structure is simple. Meanwhile, the upper folding part 23, the left ring part 21 and the right ring part 22 can also be connected by means of integrated forming, gluing, welding and the like. In this embodiment, the upper folding part 23, the left ring part 21 and the right ring part 22 are preferably integrally formed, so that a producer does not perform an additional mounting operation. The mounting step is simple, and the production efficiency is relatively high.

A material of the left ring part 21 and the right ring part 22 is preferably a hard material, so that the shape of the entire supporting ring 2 is maintained by the hard left ring part 21 and the hard right ring part 22, and the following phenomenon is prevented: excessive deformation of the supporting ring 2 affects the shape of the tub body 1 and the use of the entire folding bathtub.

Figure 3:
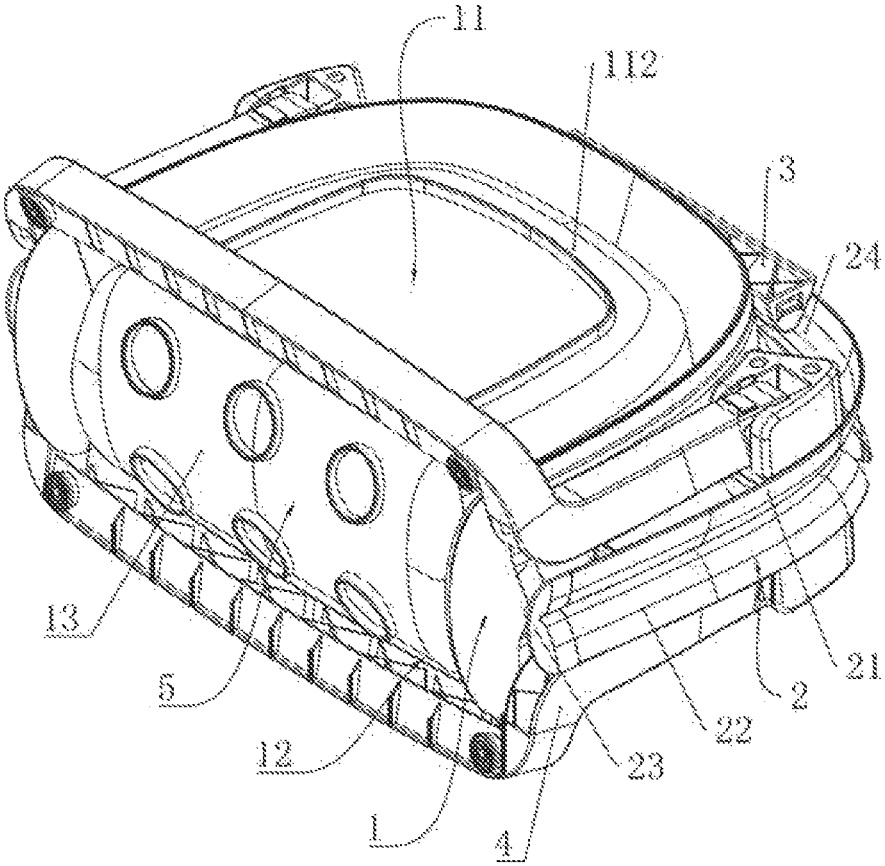
FIG. 3 is a schematic structural diagram of a folded state of the present disclosure.
Figure 5:
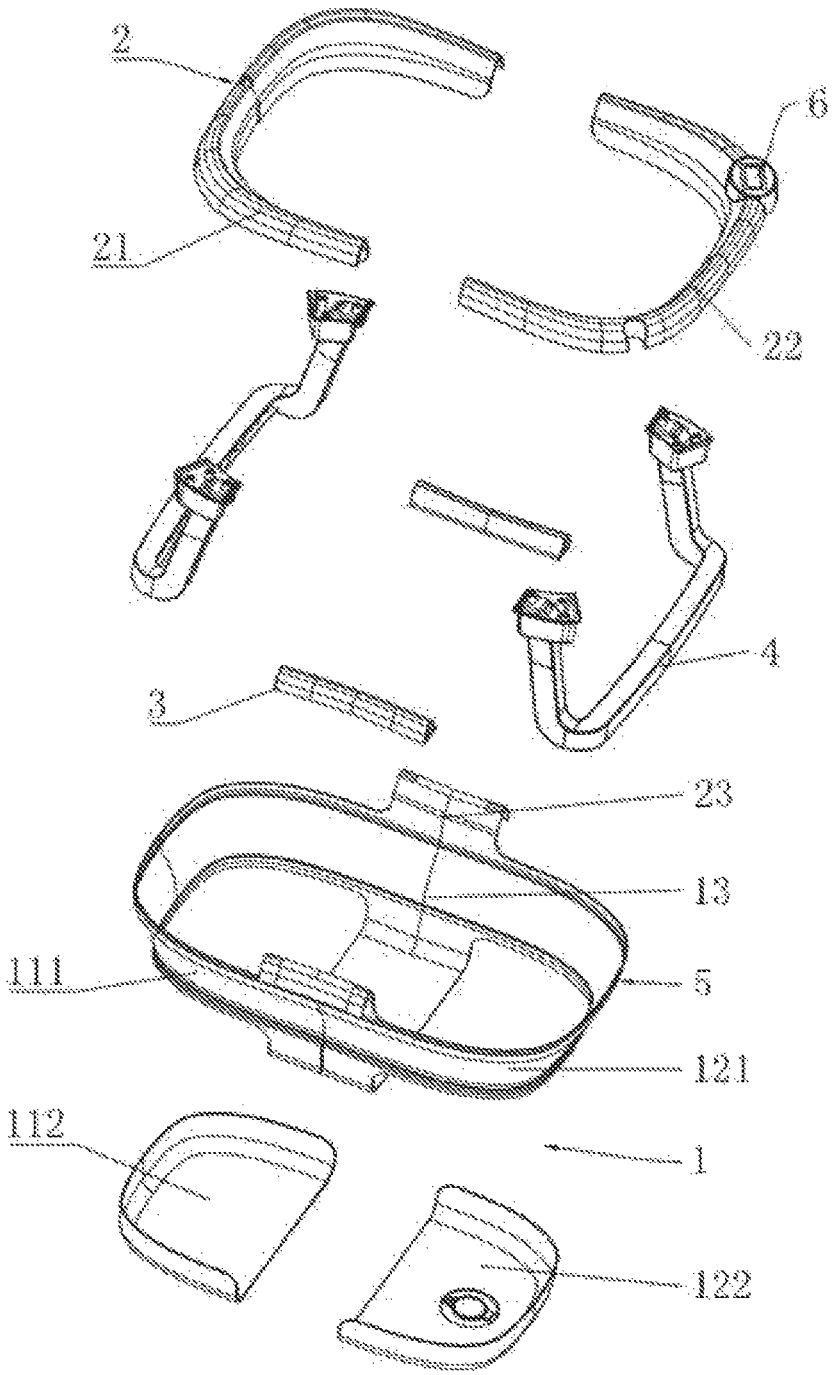
FIG. 5 is an exploded diagram of the present disclosure.

Referring to FIG. 1, FIG. 3 and FIG. 5, the tub body 1 includes a lower folding part 13, a left tub body 11 and a right tub body 12. The left tub body 11 and the right tub body 12 are respectively connected to the left ring part 21 and the right ring part 22. The lower folding part 13 is arranged between the left tub body 11 and the right tub body 12, and is connected to the upper folding part 23. The lower folding part 13 is made of a soft material. In this embodiment, the upper folding part 23 and the lower folding part 13 are preferably integrally formed. Therefore, the upper folding part 23 deforms to drive the lower folding part 13 to deform. Transverse folding between the left tub body 11 and the right tub body 12 can be achieved by means of transverse deformations of the upper folding part 23 and the lower folding part 13, so that transverse folding of the entire folding bathtub is achieved.

Figure 2:
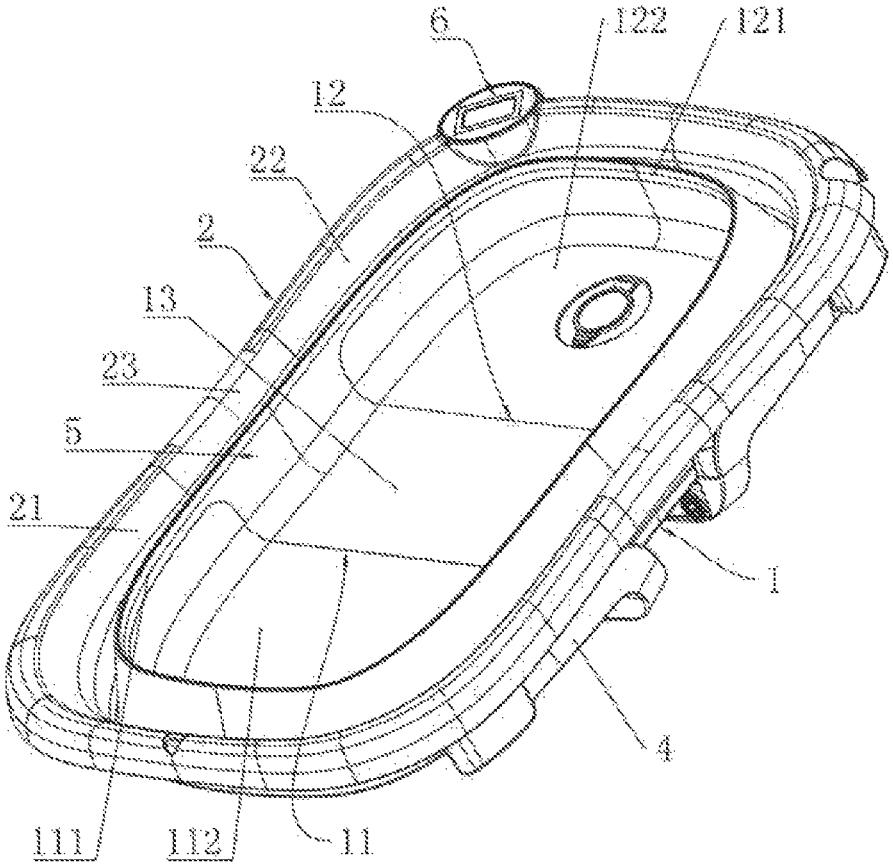
FIG. 2 is a schematic structural diagram of an up-and-down contracting state of the present disclosure.

Referring to FIG. 1, FIG. 2 and FIG. 5, upper ends of the left tub body 11 and the right tub body 12 are respectively provided with a left extensible part 111 and a right extensible part 121 which are both "U"-shaped strips; two ends of each "U"-shaped strip are respectively connected to two sides of the lower folding part 13; and the left extensible part 111 and the right extensible part 121 have certain heights in a height direction, so as to facilitate the extension and contraction of the tub body 1. The left extensible part 111 and the right extensible part 121 are respectively connected to the left ring part 21 and the right ring part 22; and the left extensible part 111 and the right extensible part 121 are both made of a soft material, so that a user applies a force to the supporting ring 2 or the tub body 1, and extensible folding up and down between the supporting ring 2 and the tub body 1 is achieved through the deformations of the left extensible part 111 and the right extensible part 121 as well as the lower folding part 13.

As shown in FIG. 3, folding up and down is achieved first through the left extensible part 111 and the right extensible part 121, and transverse folding is then achieved through the upper folding part 23 and the lower folding part 13. Therefore, the folding bathtub is folded for multiple times, and a storage space of the folding bathtub is smaller.

Figure 4:
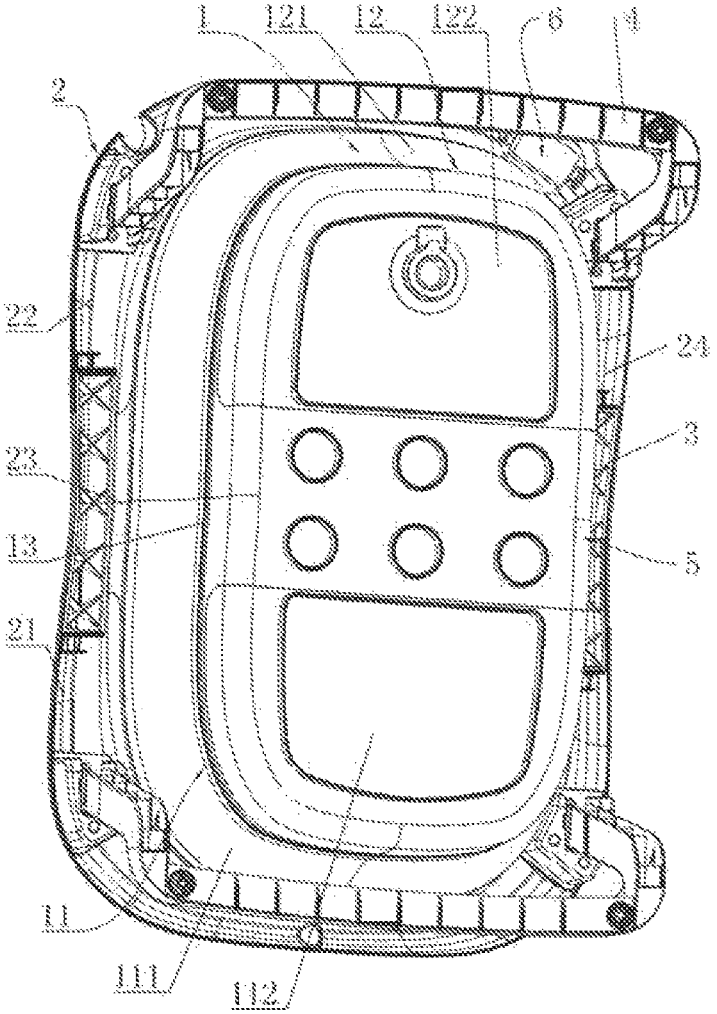
FIG. 4 is a schematic structural diagram of a bottom surface of the present disclosure.

Referring to FIG. 1, FIG. 4 and FIG. 5, lower ends of the left tub body 11 and the right tub body 12 are respectively provided with a left supporting part 112 and a right supporting part 122; and the left supporting part 112 and the right supporting part 122 are both made of a hard material to limit the deformation of the bottom of the tub body 1, so that the tub body 1 is maintained in a certain shape to facilitate the use by the user.

Figure 6:
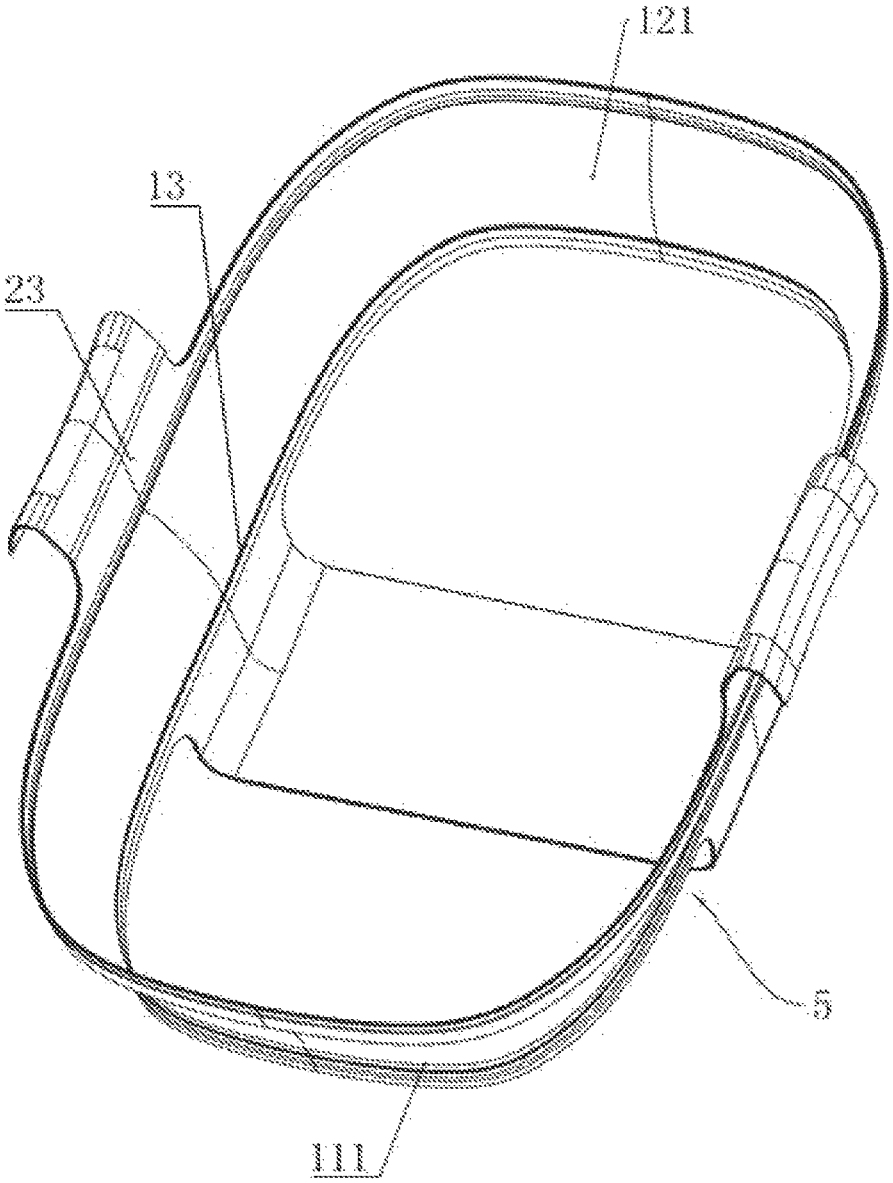
FIG. 6 is a schematic structural diagram of a soft folding part.

As shown in FIG. 5 and FIG. 6, in this embodiment, the left extensible part 111, the right extensible part 121, the upper folding part 23 and the lower folding part 13 are integrated to form a soft folding part 5, so that the connection between the folding structures of the folding bathtub is firmer, and it is more convenient for the producer to produce the bathtub. The left extensible part 111, the right extensible part 121, the upper folding part 23, the lower folding part 13, the left ring part 21, the right ring part 22, the left supporting part 112 and the right supporting part 122 are all integrally formed, that is, the supporting ring 2 and the tub body 1 are integrally formed, and the entire folding bathtub is connected into a whole, thus improving the intensity of the entire folding bathtub, reducing gaps between the structures of the folding bathtub, and improving the airtightness of the folding bathtub to reduce the possibility of water leakage during use of the folding bathtub.

As shown in FIG. 4, a lower surface of the upper folding part 23 is provided with a stopper 3. In this embodiment, an edge of the supporting ring 2 is downwards folded to form a ring slot 24. The stopper 3 is a long-strip block clamped in the ring slot 24. It is preferable that a clamping hole is formed in the ring slot 24, and a clamping block is arranged on the stopper 3. The clamping block is in clamping fit in the clamping block.

Two ends of the stopper 3 respectively extend to the left ring part 21 and the right ring part 22 to limit downward rotation of the left ring part 21 and the right ring part 22, thus preventing the supporting ring 2 from downwards deforming to affect the shape of the tub body 1 and the use of the entire folding bathtub.

As shown in FIG. 3, when the folding bathtub is in a folded storage state, the stopper 3 may also be possibly placed at an edge of the supporting ring 2, so as to facilitate the storage of the stopper 3 and also minimize the storage space required by the entire folding bathtub.

The soft material may adopt silica gel or soft plastic, such as TPE, and the hard material may adopt hard plastic, such as PP or ABS.

As shown in FIG. 1, when the entire folding bathtub is unfolded, the supporting feet 4 on the two sides of the supporting ring 2 can rotate out and be supported on the ground to prevent such a phenomenon that the tub body 1 leans against the ground, so that the tub body 1 has an extensible deformation that affects the use by the user. As shown in FIG. 2 and FIG. 3, when the folding bathtub is folded and stored, the supporting feet 4 rotate to lean against the supporting ring 2, so that it is convenient to store the entire folding bathtub.

As shown in FIG. 1, a temperature measurement device 6 is further arranged on the supporting ring 2, and is used for detecting and displaying a temperature of the liquid in the tub body 1, so that it is convenient for the user to observe the temperature and use the folding bathtub. The specific working process of this solution is as follows: As shown in FIG. 1, when the folding bathtub is completely unfolded, the folding bathtub is in a usage state. When the folding bathtub needs to be stored, the user first applies a force to the supporting ring 2 or the tub body 1, a distance between the supporting ring 2 and the tub body 1 is shortened by means of the deformations of the left extensible part 111 and the right extensible part 121, so that as shown in FIG. 2, the folding bathtub contracts to be folded in the height direction. The user only needs to apply a force to the left ring part 21 or the right ring part 22 to enable the left ring part 21 and the right ring part 22 to relatively rotate, so that the transverse folding of the folding bathtub can be achieved by means of the deformations of the upper folding part 23 and the lower folding part 13; the folding bathtub after folding is then fixed through a locking point or other clamping structures and fixing structures on the supporting ring 2; an finally as shown in FIG. 3, the folding bathtub is folded for multiple times.

Embodiment 2

This embodiment is basically the same as Embodiment 1, and a difference is that the entire tub body 1 is made of a soft material, so that when the supporting ring 2 drives the tub body 1 to be folded, the folding can be realized directly with the deformation of the tub body 1, without considering the shape of the tub body 1 and hard parts, and a user conducts the folding operation more quickly.

Embodiment 3

This embodiment is basically the same as Embodiment 1, and a difference is that the supporting ring 2 and the tub body 1 are detachably connected by means of clamping, fastener connection and the like, so that the supporting ring and the tub body can be separately folded and stored, which is more favorable for storage and use by a user.

The above description only describes embodiments of the present disclosure, and is not intended to limit the present disclosure, various modifications and changes can be made to the present disclosure. Any modifications, equivalent substitutions, improvements, etc. made within the spirit and scope of the present disclosure are intended to be included within the scope of the present disclosure.

What is claimed is:

1. A folding bathtub, comprising:

a tub body; and a supporting ring, which is arranged on the tub body, wherein the supporting ring comprises a left ring part, a right ring part and an upper folding part; the left ring part and the right ring part are respectively arranged on two sides of an upper end of the tub body; the upper folding part is arranged between the left ring part and the right ring part;

the upper folding part is made of a soft material; the supporting ring achieves rotatable folding between the left ring part and the right ring part by means of deformation of the upper folding part; and the supporting ring is folded to drive the tub body to deform and be folded;

wherein an outer edge of the supporting ring is downwards folded to form a ring slot, a lower surface of the upper folding part is provided with a stopper; and the stopper is a stop block which is clamped in the ring slot.

2. The folding bathtub according to claim 1, wherein two ends of the stopper respectively extend to the left ring part and the right ring part to limit downward rotation of the left ring part and the right ring part.

3. The folding bathtub according to claim 1, wherein the tub body comprises:

a left tub body and a right tub body, which are respectively connected to the left ring part and the right ring part; and a lower folding part, which is arranged between the left tub body and the right tub body, and is connected to the upper folding part;

wherein the lower folding part is made of a soft material; and the upper folding part deforms to drive the lower folding part to deform, which achieves folding between the left tub body and the right tub body.

4. The folding bathtub according to claim 3, wherein upper ends of the left tub body and the right tub body are respectively provided with a left extensible part and a right extensible part; the left extensible part and the right extensible part are respectively connected to the left ring part and the right ring part; the left extensible part and the right extensible part are both made of a soft material; and extensible folding up and down between the supporting ring and the tub body is achieved through the deformations of the left extensible part and the right extensible part as well as the lower folding part.

5. The folding bathtub according to claim 4, wherein lower ends of the left tub body and the right tub body are respectively provided with a left supporting part and a right supporting part; and the left supporting part and the right supporting part are both made of a hard material to limit the deformation of the tub body.

6. The folding bathtub according to claim 5, wherein the left extensible part, the right extensible part, the upper folding part and the lower folding part are integrated to form a soft folding part.

7. The folding bathtub according to claim 1, wherein the upper folding part, the left ring part and the right ring part are integrally formed, and the left ring part and the right ring part are both made of a hard material.

8. The folding bathtub according to claim 1, wherein the supporting ring and the tub body are integrally formed.

9. The folding bathtub according to claim 5, wherein the soft material is a thermoplastic elastomer (TPE) or silica gel, and the hard material is polypropylene (PP) or acrylonitrile butadiene styrene (ABS).

10. A folding bathtub, comprising:

a tub body; and a supporting ring, which comprises a first ring part, a second ring part and a first folding part, wherein the first ring part and the second ring part are respectively arranged on two sides of an upper end of the tub body; the first folding part is arranged between the left ring part and the right ring part;

the first folding part is made of a soft material; the supporting ring achieves rotatable folding of the first ring part relative to the second ring part by means of deformation of the first folding part, and then the supporting ring is folded to drive the tub body to deform and be folded;

wherein an outer edge of the supporting ring is downwards folded to form a ring slot, a lower surface of the upper folding part is provided with a stopper; and the stopper is a stop block which is clamped in the ring slot.

11. The folding bathtub according to claim 10, wherein two ends of the stopper respectively extend to the first ring part and the second ring part to limit downward rotation of the first ring part and the second ring part.

12. The folding bathtub according to claim 10, wherein the tub body comprises:

a first tub body and a second tub body, which are respectively connected to the first ring part and the second ring part; and a second folding part, which is arranged between the left tub body and the right tub body, and is connected to the first folding part;

wherein the second folding part is made of a soft material; and the first folding part deforms to drive the second folding part to deform, which achieves folding between the first tub body and the second tub body.

13. The folding bathtub according to claim 12, wherein one end of the first tub body and one end of the second tub body are respectively provided with a first extensible part and a second extensible part; the first extensible part and the second extensible part are respectively connected to the first ring part and the second ring part; the first extensible part and the second extensible part are both made of a soft material; and extensible folding up and down between the supporting ring and the tub body is achieved through the deformations of the first extensible part and the second extensible part as well as the second folding part.

14. The folding bathtub according to claim 13, wherein lower ends of the first tub body and the second tub body are respectively provided with a first supporting part and the second supporting part; the first supporting part and the second supporting part are both made of a hard material to limit the deformation of the tub body; and the first extensible part, the second extensible part, the first folding part and the second folding part are integrated to form a soft folding part.

* * * * *